US011760545B1

(12) United States Patent
Wade et al.

(10) Patent No.: US 11,760,545 B1
(45) Date of Patent: Sep. 19, 2023

(54) CLOSURE FOR A MEMBRANE SEALED CONTAINER

(71) Applicants: Gordon Dwight Wade, Clearwater, FL (US); Gary M. Burns, Lewiston, NY (US); Robert C. Lux, East Concord, NY (US)

(72) Inventors: Gordon Dwight Wade, Clearwater, FL (US); Gary M. Burns, Lewiston, NY (US); Robert C. Lux, East Concord, NY (US)

( * ) Notice: Subject to any disclaimer, the term of this patent is extended or adjusted under 35 U.S.C. 154(b) by 0 days.

(21) Appl. No.: 17/020,577

(22) Filed: Sep. 14, 2020

Related U.S. Application Data

(60) Provisional application No. 62/899,475, filed on Sep. 12, 2019.

(51) Int. Cl.
*B65D 51/22* (2006.01)

(52) U.S. Cl.
CPC .... *B65D 51/222* (2013.01); *B65D 2251/0028* (2013.01); *B65D 2251/0093* (2013.01)

(58) Field of Classification Search
CPC ..... B65D 51/222; B65D 2251/0028; B65D 2251/0093; B65D 2251/0015; B65D 51/20; B65D 2401/10
See application file for complete search history.

(56) References Cited

U.S. PATENT DOCUMENTS

| | | | | |
|---|---|---|---|---|
| 4,340,147 A * | 7/1982 | McIntosh | B65D 51/223 215/226 |
| 6,024,234 A * | 2/2000 | Rink | B65D 51/223 215/250 |
| 7,083,058 B2 * | 8/2006 | Perry | B65D 51/223 215/351 |
| 9,376,240 B1 * | 6/2016 | McMurray | B65D 41/3461 |

* cited by examiner

*Primary Examiner* — Shawn M Braden
(74) *Attorney, Agent, or Firm* — Phillips Lytle LLP; David L. Principe

(57) ABSTRACT

A closure assembly for piercing and creating access to a container whose mouth is normally sealed by a thin membrane applied to a rim of the container.

21 Claims, 10 Drawing Sheets

DETAIL B
SCALE 2.000

CLOSURE FOR A MEMBRANE SEALED CONTAINER

TECHNICAL FIELD

The invention relates generally to a closure for membrane sealed containers and more specifically to an improved closure constructed to open the mouths of membrane sealed containers.

BACKGROUND ART

Membrane sealed containers are finding widespread commercial use as consumer health and safety considerations continue to rise. In order to prevent undetectable tampering or accidental spillage of medicine, foodstuffs, cleaning products, automotive, and lawn and garden products in either a liquid or solid, the product is encased in a membrane-sealed glass or plastic container. In many instances it is desirable that the sealed container be opened without a person's hands coming into contact with the material inside the container, and without the need for additional tools.

It may also be important that the membrane not break off and fall into the contents of the bottle after it is opened. It may further be important to be able to reseal the bottle if it is not completely emptied after use (or after partial use of its contents).

Various devices have been used to open membranes of the type discussed herein, such devices including those disclosed in U.S. Pat. No. 4,634,013 which includes a cutting device. U.S. Pat. No. 5,505,326 discloses a cap having a plurality of cutters which puncture the membrane requiring that the consumer tear-out the remaining membrane. U.S. Pat. No. 5,090,582 discloses a cap including a cutting device which incorporates a plow base member along its sidewall, thereby preventing the membrane from falling into the container after it has been cut. U.S. Pat. No. 4,993,569 discloses a piercing closure device wherein, prior to opening the cap, the consumer presses down on the cap and thereby pierces the membrane. U.S. Pat. No. 3,887,099 discloses a cap having internal cutters whereby the membrane is cut along its edges when a consumer pushes down on the cap.

BRIEF SUMMARY OF THE INVENTION

With parenthetical reference to the corresponding parts, portions or surfaces of the disclosed embodiment, merely for the purposes of illustration and not by way of limitation, the present invention provides a closure assembly (20) for a membrane sealed container. The closure assembly (20) includes an annular side wall (35). A top wall (32) having an outer surface (31) is connected to the annular side wall (35). The top wall (32) has a central outer surface (50) that is surrounded by a recessed surface (47).

An annular ring (29) extends upward from the outside surface (31) of the top wall (32). The recessed surface (47) extends between the annular ring (29) and the center outer surface (50) to form a channel for receiving the top rim of the membrane sealed container when the closure assembly (20) is inverted. The center outer surface (50) supports piercing members (53) and directional plows (56, 74).

The piercing member (53) is disposed on the center outer surface (50) in spaced apart relation to the annular ring (29). The at least one piercing member (53) has a first height above the center outer surface (50). A directional plow (56, 74) is disposed on the center outer surface (50) in spaced apart relation to the at least one piercing member (53). The directional plow (56, 74) has a second height above the center outer surface (50) that is less than the first height of the at least one piercing member (53).

DESCRIPTION OF THE PREFERRED EMBODIMENTS

Figure 1:
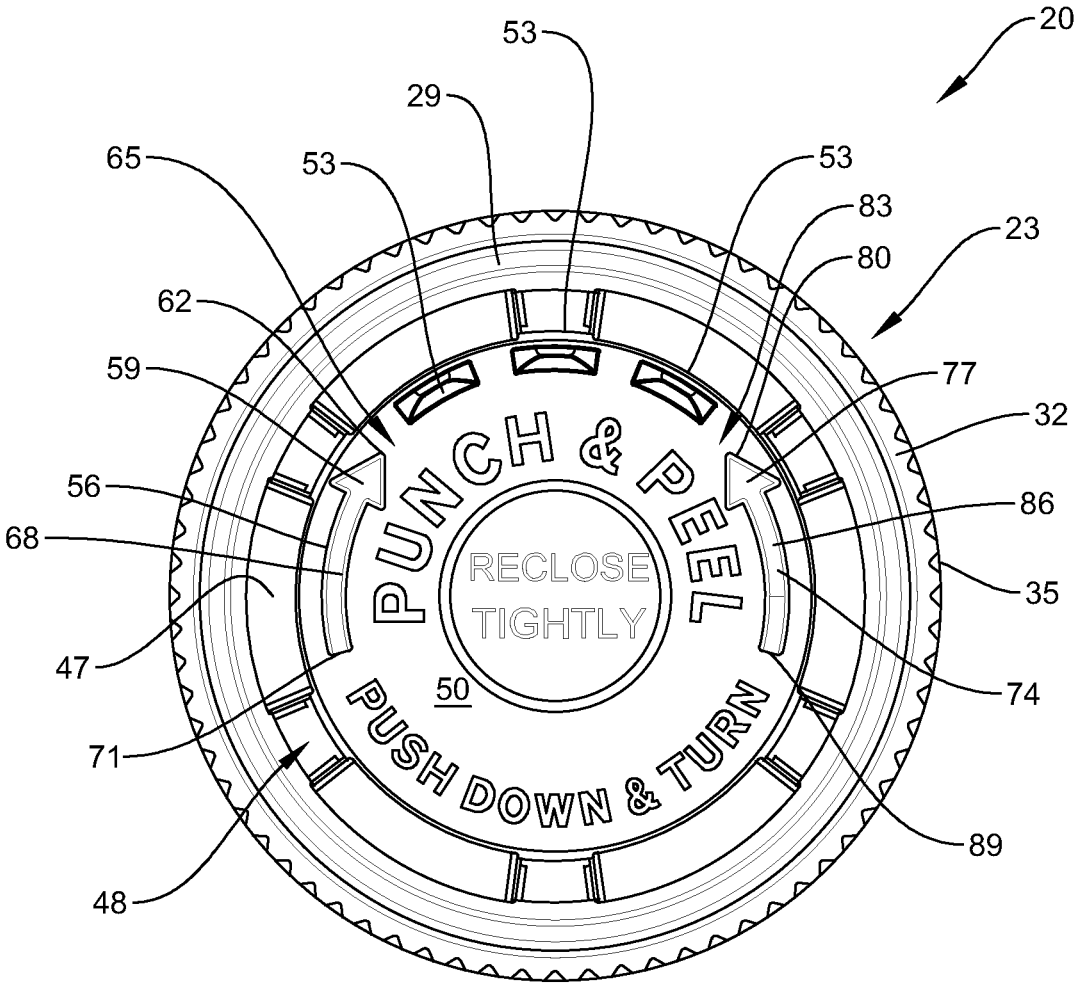
FIG. 1 is a top plan view of the closure assembly of the present invention.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Figure 2:
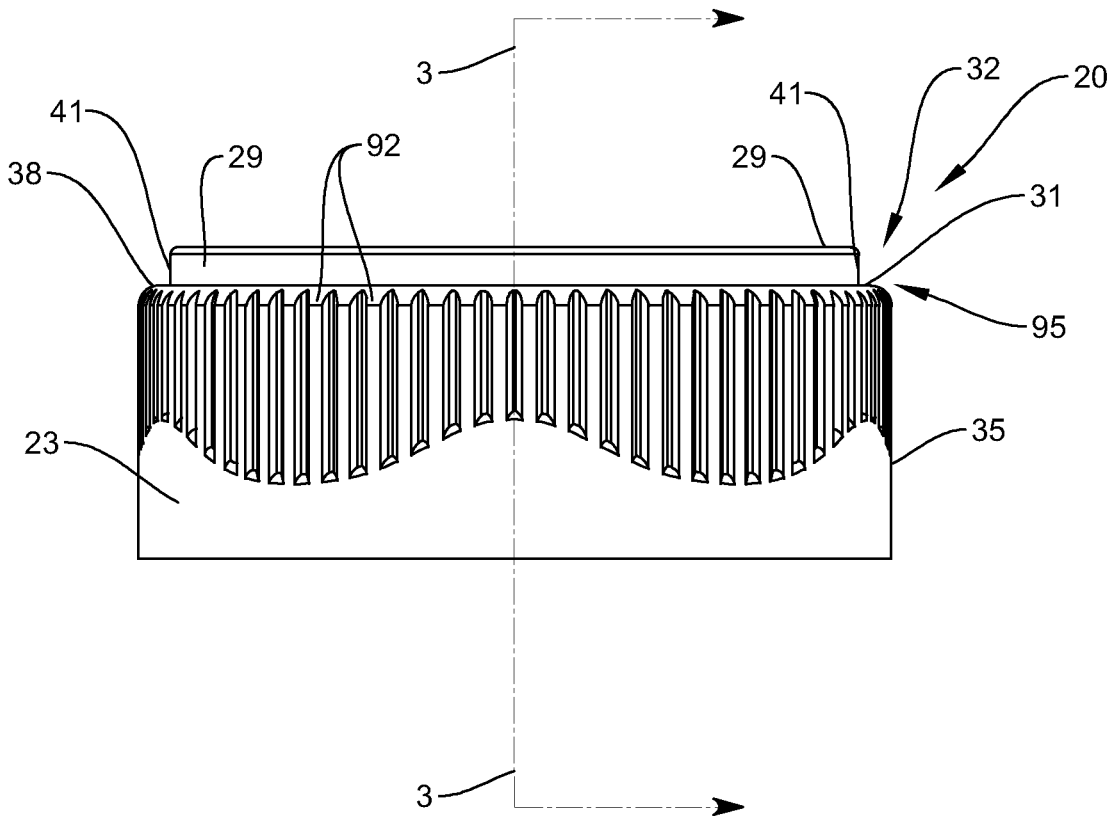
FIG. 2 is a front elevation of the closure shown in FIG. 1.
Figure 3:
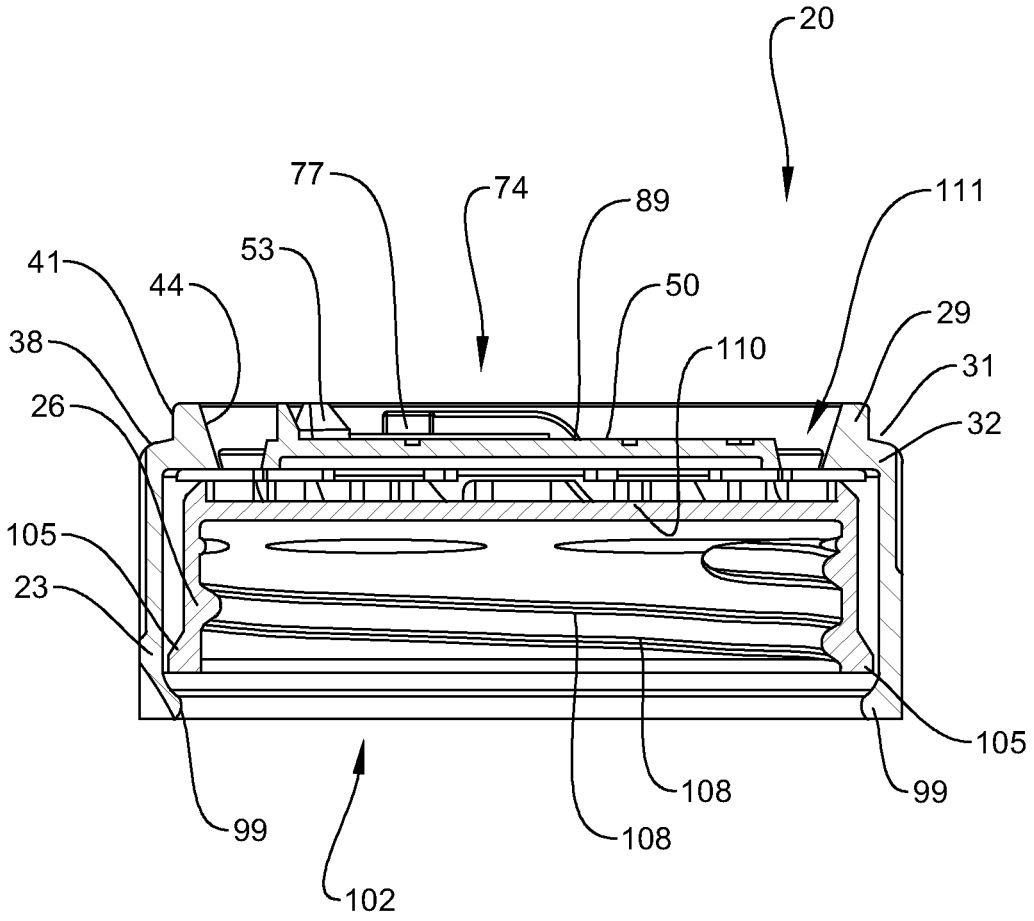
FIG. 3 is a cross sectional view taken along lines 3-3 of FIG. 2.

Referring generally to FIGS. 1-10, and initially to FIG. 1 thereof, this invention provides a closure assembly 20. The closure assembly 20 shown in FIGS. 1-3 may be constructed of a closure shell 23 and a closure core 26 (FIG. 3). As an alternative, the closure of the present invention may be constructed as a unitary member. The closure shell 23 may be provided with an annular ring 29 extending upward from a top surface 31 of a top wall 32. The annular ring 29 may be continuous or the annular ring 29 may be formed by a series of arc sections with openings defined between. The top surface 31 extends inward from a side wall 35. As best shown in FIG. 2, from the outside edge 38 of the top surface 31, the top surface 31 extends inward radially until it reaches an outer surface 41 of the annular ring 29. The opposite inner surface 44 (FIG. 3) of the annular ring 29 is disposed inward in the radial direction from the outer surface 41. A recessed surface 47 (FIG. 1) extends between the inner surface 44 and center outer surface 50. The recessed surface 47 is located at a predetermined depth below the center outer surface 50. The recessed surface 47 may be provided with openings 48 for reducing the weight and material usage associated with the closure shell 23. The openings 48 may also allow water to drain when the bottle is placed on outdoor shelving exposing the bottles and closures to rain and snow. Returning to FIG. 1, center outer surface 50 is provided with one or more piercing members 53 disposed along a curved path. As shown there may be three piercing members 53 disposed along a circular arc.

There may be a pair of directional plows 56, 74 disposed at opposite ends of the group of piercing members 53. The directional plows 56 may be formed in the shape of an arrow with a head portion 59 and a pointed tip 62 at a first end 65. A body portion 68 may extend from the head portion 59 to an opposite end 71. The body portion 68 may be curved along the same arc as the piercing members 53. Plow 56 may be oriented such that the arrow points in the clockwise direction.

Directional plow 74 is disposed on the opposite side of the piercing members 53. Directional plow 74 may be provided with a triangular head portion 77 having a point 80 at a first end 83. A body portion 86 extends from the head portion 77 to a second end 89. The body portion 86 may be curved along the same arc as the piercing members 53. Plow 74 may be oriented such that the arrow points in the counter clockwise direction.

The directional plows 56, 74 extend above the center outer surface 50 at a height that is less than the height of the piercing members 53 above the center outer surface 50.

Turning to FIG. 2, sidewall 35 may have a plurality of ribs 92 disposed thereon. The ribs 92 provide for gripping the outside surface of the sidewall 35 for removing the cap from a container. The side wall 35 extends to a short, curved section 95 that joins with the top surface 31. The annular ring 29 extends above the top surface 31.

In FIG. 3, a cross-section shows the construction of the closure assembly 20. The closure assembly 20 may be constructed of a closure shell 23 and a closure core 26. Alternatively, the closure assembly 20 may be molded as a unitary structure. As shown in FIG. 3, the closure core 26 may be installed in the closure shell 23 to form the closure assembly 20. The closure shell 23 may be provided with an inward extending rib 99 at the bottom opening 102. The bottom opening 102 receives the closure core 26 which may fit by snapping into place after a protrusion 105 at the bottom of the closure core 26 slides past the rib 99 on the closure shell 23. The closure shell 23 may be formed from an elastomeric material capable of resiliently deflecting at the bottom to receive the closure core 26 in snap-fit arrangement. Other ways for connecting the closure shell 23 to the closure core 23 will be evident to persons of ordinary skill in the art based on this disclosure. The inside surface of the closure core 26 may be provided with threads 108. The threads 108 may be designed to engage with threads on the outside of the sealed container or bottle. The closure core 26 is provided with an upper wall 110 that forms the top of a chamber formed when the closure assembly 20 is attached to the container.

Between the center outer surface 50 and the annular ring 29, there is an opening 111 that leads to the recessed surface 47. The recessed surface 47 increases penetration of the piercing members 53. The recessed surface 47 allows the piercing members 53 to penetrate farther into the heat induction seal, thus assuring a successful removal of the seal no matter what foil thickness or type of laminate. The recessed surface 47 permits the raised alignment wall to have a shorter height, which maintains a greater clearance gap between the corrugated folded lids on the shipment carton for the bottle.

Opening 111 receives the top edge of the open end of the container when the closure assembly 20 is removed from the container, inverted, and pressed against the container as described in greater detail below.

Figure 4:
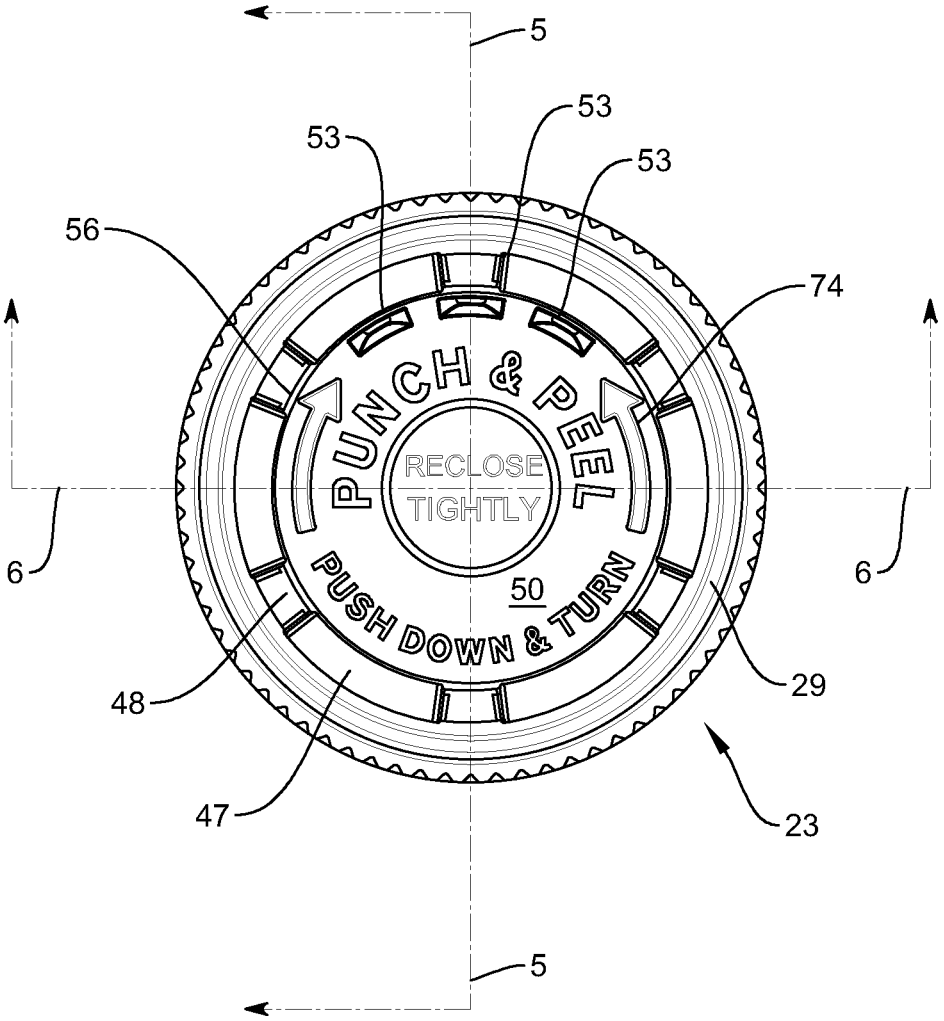
FIG. 4 is a top plan view of the closure shell of the present invention.

In FIGS. 4-8, the closure shell 23 is shown in greater detail. In FIG. 4, the center surface 50 is shown in the form of a circular area at the center of the shell 23. The center surface 50 may also be formed in other shapes such as annular or the like. The surface 50 may be provided with raised lettering or depressions forming lettering for instructions to the user. The recessed surface 47 is located below the center outer surface 50 and forms a channel between the center surface 50 and the annular ring 29. The channel receives the top rim of the container or bottle when the closure assembly 20 is inverted and pressed onto the end of the container or bottle for piercing and cutting the membrane. The recessed surface 47 may be solid or it may be provided with openings 48. The directional plows 56 and 74 are disposed on opposite sides of the center surface 50 and provide for maintaining tension on the membrane for operation of the piercing members 53 yet prevent the membrane from completely separating from the top rim and falling into the interior of the container or bottle.

Figure 5:
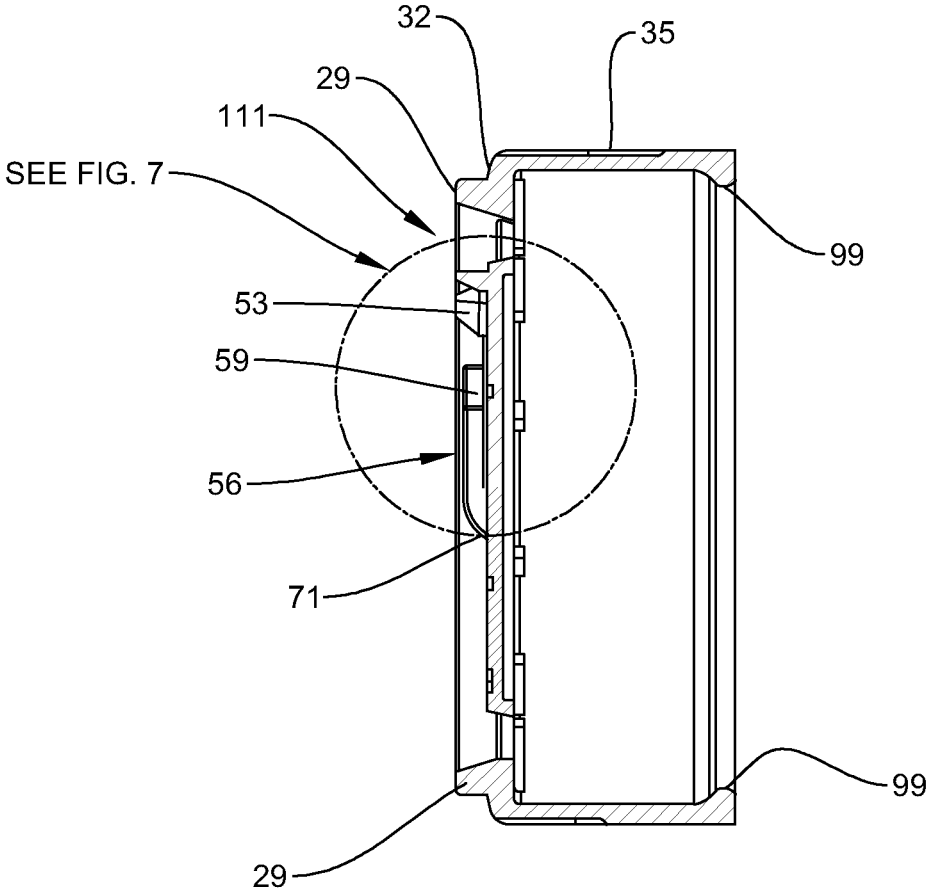
FIG. 5 is a cross-sectional view taken along lines 5-5 of FIG. 4.
Figure 6:
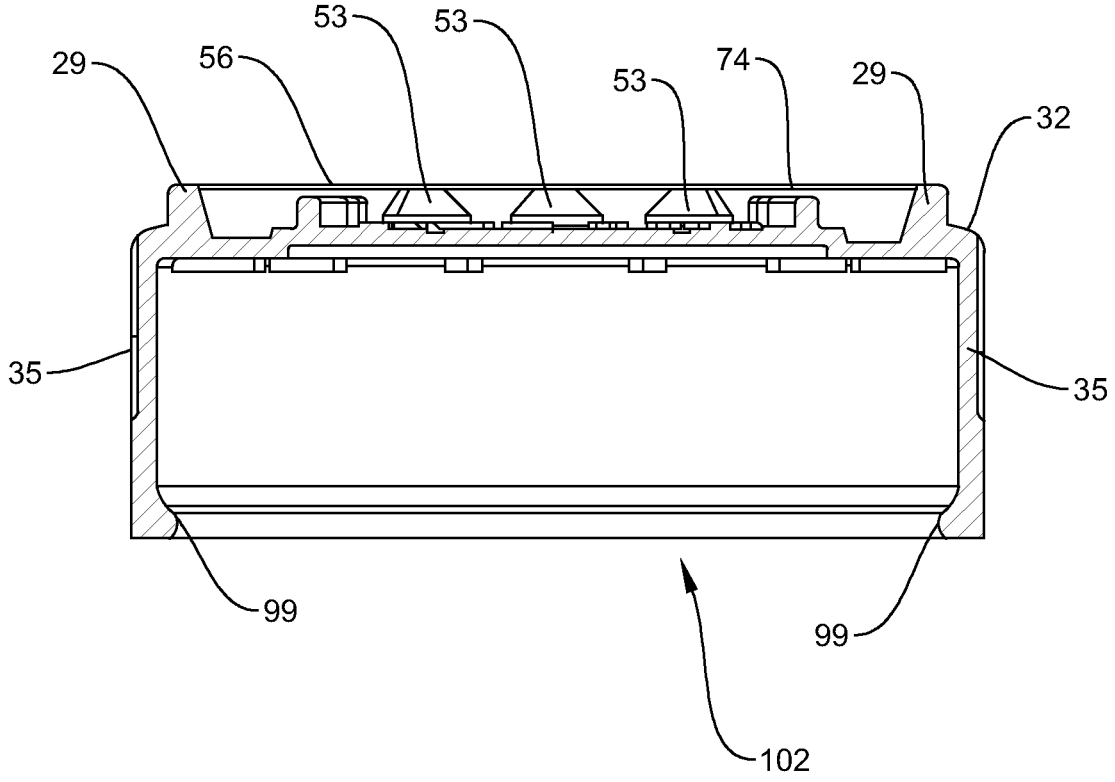
FIG. 6 is a cross-sectional view taken along lines 6-6 of FIG. 4.
Figure 7:
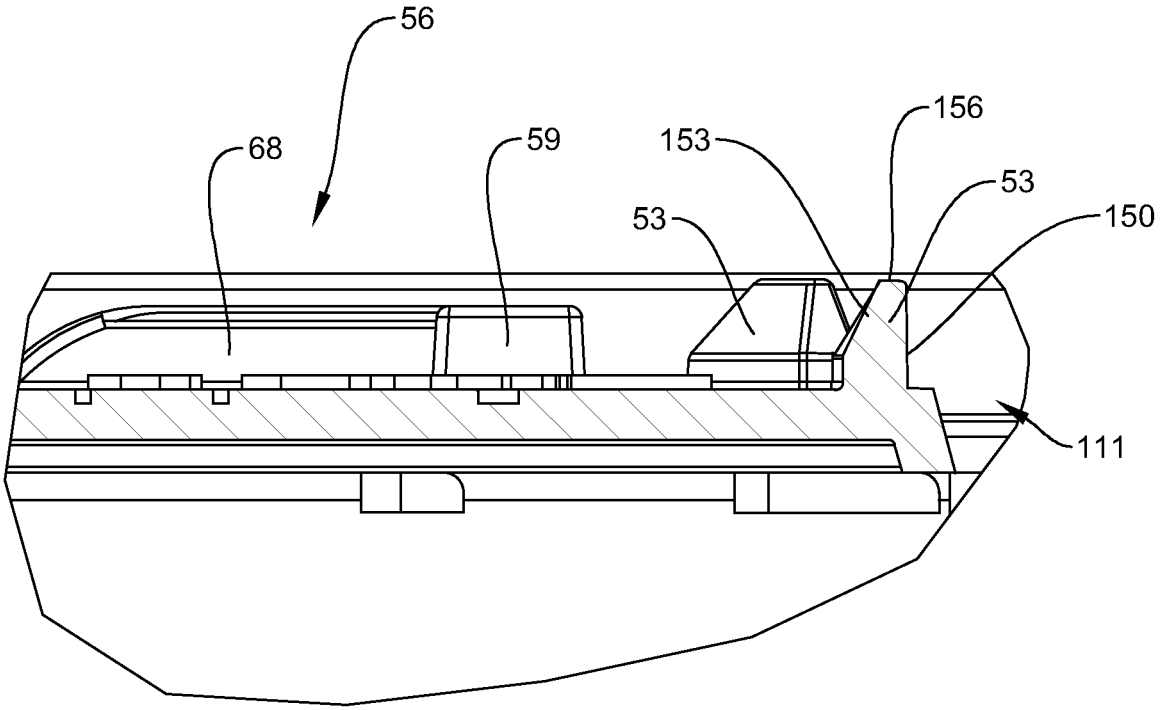
FIG. 7 is enlarged view of a portion of FIG. 5.
Figure 8:
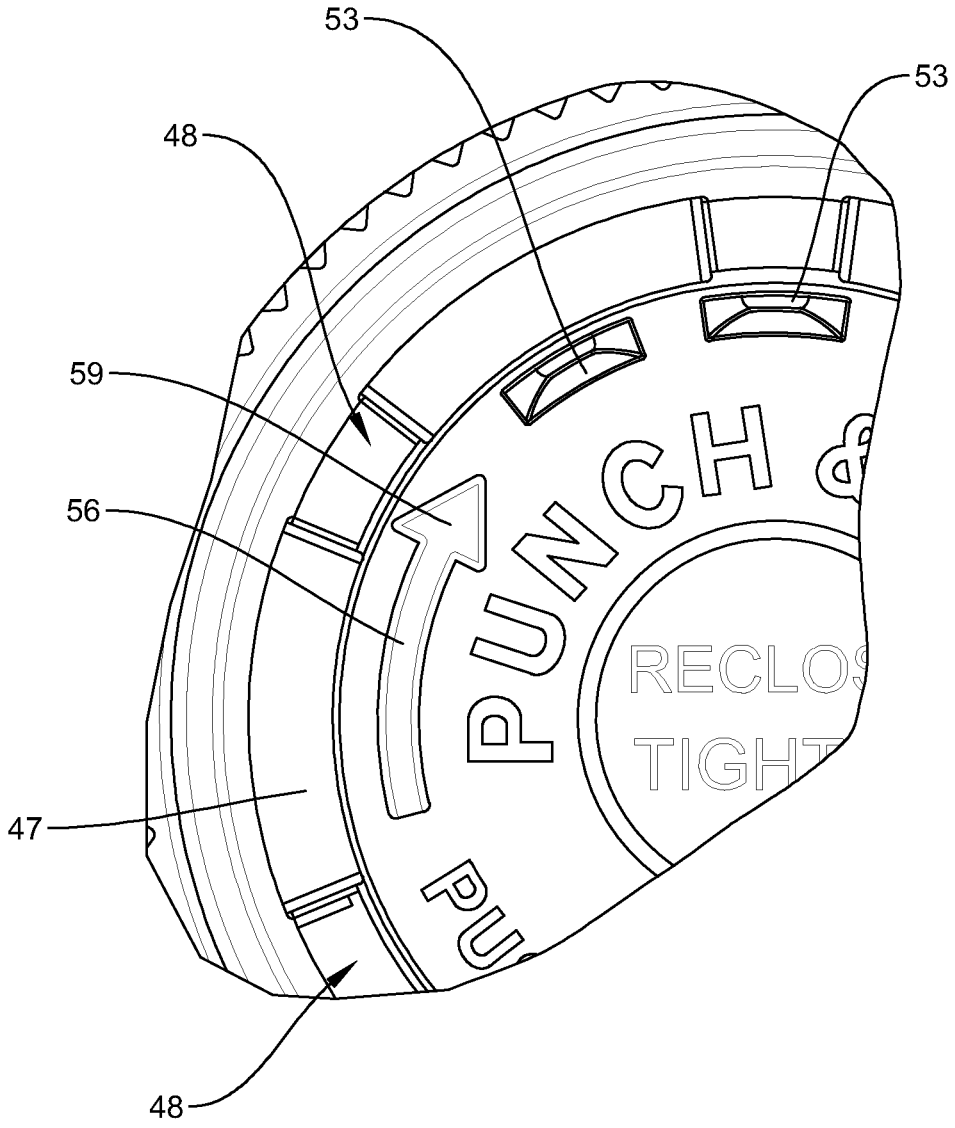
FIG. 8 is an enlarged view of a portion of FIG. 4.

In FIGS. 5 and 7, the directional plow 56 and the piercing members 53 are shown in greater detail. Referring to FIG. 7, the piercing member 53 may be formed with a first wall 150, a second angled wall 153, and a top wall 156. As shown, the edges of the piercing member 53 may be rounded. The top wall 156 may be substantially flat. The relatively narrow thickness and the length of the piercing members 53 cause them to pierce the membrane. Also, a channel is formed between the center surface 50 and the annular ring 29. The channel extends down to the recessed surface 47 and provides the piercing members 53 with space to penetrate the membrane to a greater depth than a closure without a recessed surface.

The directional plows 56 and 74 have a height above the center outer surface 50 that is less than the height of the piercing members 53 above the center outer surface 50.

Figure 9:
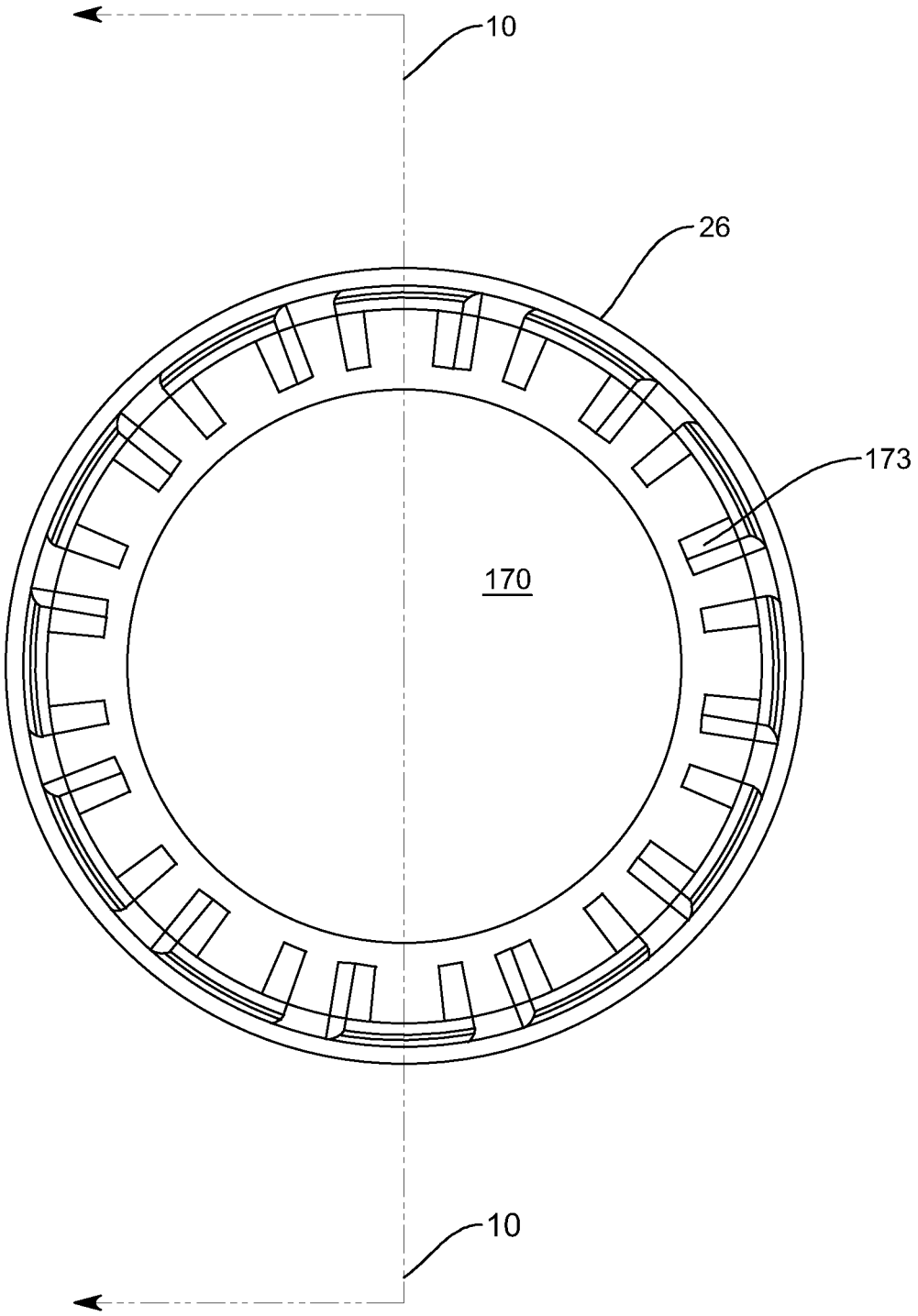
FIG. 9 is a top plan view of the closure core of the present invention.
Figure 10:
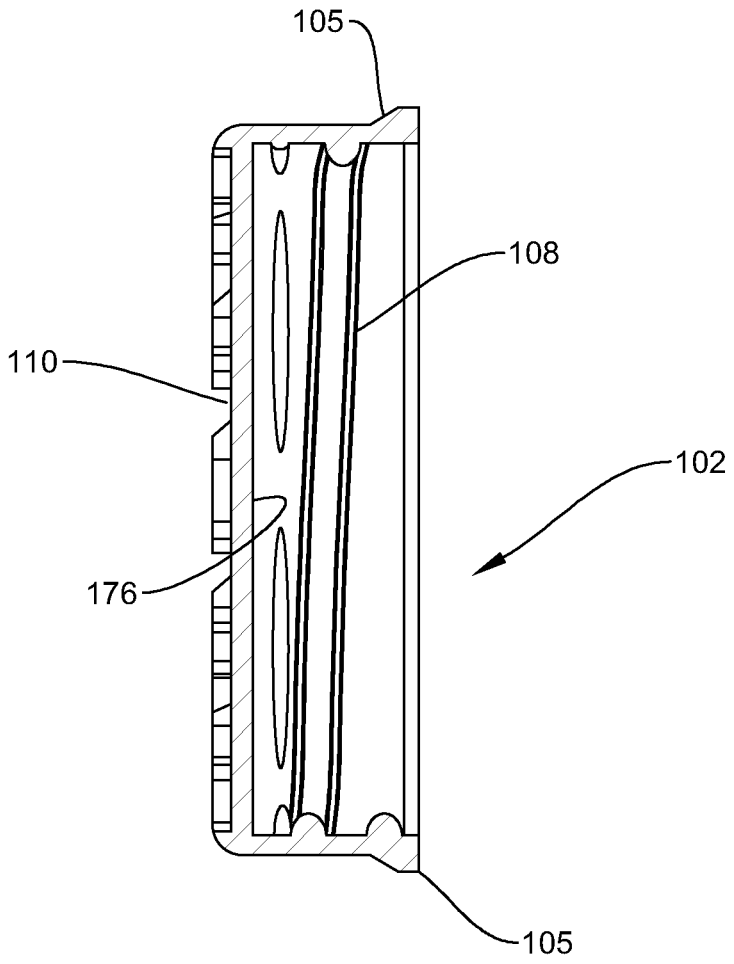
FIG. 10 is a cross-sectional view taken along lines 10-10 of FIG. 9.

In FIGS. 9-10, the closure core 26 is shown in detail. In FIG. 9, the upper wall 110 has an outer surface 170. Outer surface 170 may be provided with projections 173 for engaging with the underside of the closure shell 23 when the shell 23 and the core 26 are joined to form the assembly 20. Turning to FIG. 10, upper wall 110 has an inner surface 176 that engages with the top of the rim of the container or bottle when the closure assembly 20 is attached to the container of bottle in the closed position.

In use, the closure assembly 20 is removed from the neck of the container or bottle, and the user inverts the closure assembly 20. The inverted assembly 20 is physically placed on the top rim of the neck of the container where the sealing membrane is attached. The closure assembly 20 may be aligned by inserting the assembly 20 onto the neck of the container or bottle such that the top circular rim is directed into the space between between the annular ring 29 and the center surface 50. The closure assembly 20 is pushed down onto the end of the container or bottle until the top of the rim engages with the recessed surface 47. At this point the piercing members 53 are inserted at maximum depth into the container or bottle.

Once the closure assembly 20 is aligned in the opening 111 as discussed above, the user will forcefully press the closure assembly 20 in a downward motion against the sealing membrane to permit the plurality of piercing members 53 to break or tear through the sealing membrane. Once the membrane is pierced, the user turns the inverted closure assembly 20 clockwise or counterclockwise approximately one full revolution to complete the tearing and separation of the membrane from the neck. The neck with the membrane removed provides a pouring diameter. Finally, the partially separated membrane can be physically removed to pour some or all of the contents from the container or bottle.

The recessed surface 47 provides additional depth for inserting the closure assembly 20 into the membrane such that the piercing members 53 provide a deeper penetration of the membrane. The directional plows 56, and 74 have a height above the center surface 50 that is less than the height of the piercing member 53 above the surface 50. As the cap assembly 20 is rotated approximately one revolution or 360 degrees, the combination of the piercing members 53 and the directional plows 56 and 74 provide for removal of about eighty percent of the membrane or foil material that covers the opening to the container or bottle. Accordingly, the membrane or foil can be removed from the container or bottle without the risk of the membrane falling into the container after being cut by the piercing members 53.

The present invention contemplates that many changes and modifications may be made. Therefore, while the presently-preferred form of the closure assembly has been shown and described, and several modifications and alternatives discussed, persons skilled in this art will readily appreciate that various additional changes and modifications may be made without departing from the spirit of the invention, as defined and differentiated by the following claims.

The invention claimed is:

1. A closure for a membrane sealed container, said closure comprising:

an annular side wall;

a top wall connected to said annular side wall, the top wall having a center outer surface;

an annular ring extending upward from the top wall, a recessed surface disposed between the annular ring and the center outer surface, the recessed surface configured to form a channel for receiving the top rim of the membrane sealed container when the closure device is inverted and pushed against the top of the membrane sealed container;

at least one piercing member disposed on the center outer surface in spaced apart relation to the annular ring, the at least one piercing member having a first height above the center outer surface;

at least one directional plow disposed on the center outer surface separate from and in spaced apart relation to the at least one piercing member, the at least one directional plow having a second height above the center outer surface that is less than the first height of the at least one piercing member.

2. The closure device of claim 1, wherein the at least one piercing member further comprises two or more piercing members arranged along an arc.

3. The closure device of claim 1, wherein the at least one directional plow comprises a pair of directional plows disposed on opposite sides of the at least one piercing member.

4. The closure device of claim 3, wherein the directional plows further comprise arrow-shaped members having a head portion and a body portion.

5. The closure device of claim 4, further comprising a first directional plow having an arcuate body, the first directional plow being oriented in the clockwise direction.

6. The closure device of claim 5, further comprising a second directional plow having an arcuate body, the second directional plow being oriented in the counterclockwise direction.

7. The closure device of claim 1, wherein the recessed surface has a plurality of openings defined therein.

8. The closure device of claim 1, wherein an outer surface of the annular side wall has a plurality of ridges disposed thereon.

9. The closure device of claim 1, wherein an inner surface of the annular side wall has threads disposed thereon.

10. The closure device of claim 1, wherein the recessed surface allows the piercing member to penetrate farther into the membrane seal.

11. A container comprising:

a container body defining a pour orifice, said pour orifice fluidly sealed by a pierceable membrane; and a cap member constructed for attachment to said container body adjacent said pour orifice, said cap member comprising:

an annular side wall;

a top wall connected to said annular side wall, an annular ring extending upward from the top wall, a recessed surface extending between the annular ring and a center outer surface to form a channel for receiving the top of the membrane sealed container when the closure device is inverted;

at least one piercing member disposed on the center outer surface in spaced apart relation to the annular ring, the at least one piercing member having a first height above the center outer surface, the at least on piercing member configured to pierce the pierceable membrane when the cap is inverted and rotated on top of the container body adjacent the pour opening;

at least one directional plow disposed on the center outer surface separate from and in spaced apart relation to the at least one piercing member, the at least one directional plow having a second height above the center outer surface that is less than the first height of the at least one piercing member, the at least one directional plow configured to maintain tension on the pierceable membrane.

12. The closure device of claim 11, wherein the at least one piercing member further comprises two or more piercing members arranged along an arc.

13. The closure device of claim 11, wherein the at least one directional plow comprises a pair of directional plows disposed on opposite sides of the at least one piercing member.

14. The closure device of claim 13, wherein the directional plows further comprise arrow-shaped members having a head portion and a body portion.

15. The closure device of claim 14, further comprising a first directional plow having an arcuate body, the first directional plow being oriented in the clockwise direction.

16. The closure device of claim 15, further comprising a second directional plow having an arcuate body, the second directional plow being oriented in the counterclockwise direction.

17. The closure device of claim 11, wherein the recessed surface has a plurality of openings defined therein.

18. The closure device of claim 11, wherein an outer surface of the annular side wall has a plurality of ridges disposed thereon.

19. The closure device of claim 11, wherein an inner surface of the annular side wall has threads disposed thereon.

20. A closure assembly for use with a membrane sealed container, said closure assembly comprising:

a closure shell having an annular side wall;

a top wall connected to said annular side wall, the top wall having a center outer surface;

an annular ring extending upward from the top wall, a recessed surface disposed between the annular ring and the center outer surface, the recessed surface configured to form a channel for receiving the top rim of the membrane sealed container when the closure device is inverted and pushed against the top of the membrane sealed container;

at least one piercing member disposed on the center outer surface in spaced apart relation to the annular ring, the at least one piercing member having a first height above the center outer surface;

at least one directional plow disposed on the center outer surface separate from and in spaced apart relation to the at least one piercing member, the at least one directional plow having a second height above the center outer surface that is less than the first height of the at least one piercing member;

a closure core removably attached in the interior of the closure shell, the closure core configured to engage with the top of the membrane sealed container.

21. The closure assembly of claim 20, wherein the inner surface of the closure core has thread disposed thereon for engaging with corresponding threads on the top of the membrane sealed container.

* * * * *